US006234363B1

(12) United States Patent
Stradella

(10) Patent No.: US 6,234,363 B1
(45) Date of Patent: May 22, 2001

(54) DEVICE FOR DISPENSING A FLUID WITH CLOSURE SYSTEM

(75) Inventor: Giuseppe Stradella, Camogli (IT)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/355,266

(22) PCT Filed: Jan. 23, 1998

(86) PCT No.: PCT/FR98/00113

§ 371 Date: Oct. 18, 1999

§ 102(e) Date: Oct. 18, 1999

(87) PCT Pub. No.: WO98/32669

PCT Pub. Date: Jul. 30, 1998

(30) Foreign Application Priority Data

Jan. 27, 1997 (FR) ..... 97 00841

(51) Int. Cl.[7] ..... B65D 83/00
(52) U.S. Cl. ..... 222/402.12; 222/148
(58) Field of Search ..... 222/148, 321.6, 222/380, 402.12, 490; 239/492, 464, 533.12

(56) References Cited

U.S. PATENT DOCUMENTS

| | | | | |
|---|---|---|---|---|
| 2,055,582 | | 9/1936 | Lewis et al. . | |
| 3,336,000 | | 8/1967 | Barker . | |
| 3,696,977 | | 10/1972 | Davenport et al. . | |
| 3,858,773 | | 1/1975 | Del Bon . | |
| 4,182,496 | * | 1/1980 | Burke | 222/402.12 |
| 5,181,658 | * | 1/1993 | Behar | 222/380 |
| 5,370,313 | | 12/1994 | Beard . | |
| 5,624,055 | * | 4/1997 | Clanet et al. | 222/402.12 |
| 5,769,325 | * | 6/1998 | Jouillat et al. | 222/380 |

FOREIGN PATENT DOCUMENTS

| | | |
|---|---|---|
| 33 47 079 | 7/1985 | (DE) . |
| 031 123 | 7/1981 | (EP) . |
| 2 289 890 | 12/1995 | (GB) . |

* cited by examiner

*Primary Examiner*—Kevin Shaver
*Assistant Examiner*—Thach H. Bui
(74) *Attorney, Agent, or Firm*—Sughrue, Mion, Zinn, Macpeak & Seas, PLLC

(57) ABSTRACT

A dispenser device which has a pumping device, an ejection nozzle incorporating a dispensing orifice, an actuator for activating the dispenser such as a pusher, and a closure system which enables the dispenser device to be closed, thereby avoiding problems such as contamination or drying out of the dispensing substance. The closure system contains a closure element that is resiliently deformable to go between a closed position in which it hermetically closes the dispensing orifice, and an open position in which it opens the dispensing orifice. When the dispensing device is actuated, the closure element is deformed into its open position by a member solid with the ejection nozzle or the ejection nozzle, and the closure element returns resiliently into its closed position after the dispensing device has been actuated.

13 Claims, 4 Drawing Sheets

DEVICE FOR DISPENSING A FLUID WITH CLOSURE SYSTEM

BACKGROUND OF THE INVENTION

The present invention relates to a dispenser device for dispensing a fluid, and more particularly, the present invention relates to such a dispenser device that includes a closure system actuated automatically whenever the dispenser device is actuated.

The closure system of the present invention is applicable to all dispenser devices for dispensing fluids, and in particular to any such dispenser device including a pump or a valve connected to a tank and actuated by actuating means such as a pusher.

In dispenser devices for dispensing fluids or in spray dispenser devices, and particularly in devices containing substances such as medicines, one of the most complicated problems to be solved is that of avoiding the risk of at least some of the fluid that is to be dispensed becoming contaminated.

In general, such a device includes a tank containing the fluid, and a dispenser member, such as, for example, a pump, inside which some quantity of fluid always remains present after each dispensing operation. That quantity of fluid remains in contact with the outside environment via the dispensing orifice or the ejection nozzle of the dispenser member, and it can thus easily be subjected to drying and/or contamination, which gives rise to the following undesirable consequences:

- in the event of contamination, e.g. with bacteria, the contaminated fluid is dispensed to the user the next time the device is actuated, which is obviously dangerous to the user's health; in addition, the contamination can, in some cases, extend to the entire tank of fluid, resulting in an increased health risk; and
- in the event of drying, in addition to highly probable contamination, there is also a risk that the dispensing orifice of the dispenser member clogging up; this is very frequent in particular in spray dispenser devices in which the fluid passageways are usually very small.

To overcome that problem, it has been proposed to use preservative agents mixed with the fluid to be dispensed. Unfortunately, when medication is to be dispensed, that solution often gives rise to side effects such as allergy problems.

To avoid that, "closure systems" have been developed in recent years so as to provide a dispenser device whose dispensing orifice can be closed in airtight manner.

Such systems do indeed solve the problem of the substance remaining in the dispenser member drying out and/or becoming contaminated. Unfortunately, they generally give rise to considerable new problems, in particular in spray applications. Such a closure system is generally actuated, i.e. opened, by means of the pressure generated by the pump when the device is actuated. That gives rise to the following adverse consequences:

- the closure member is an integral part of the spray-producing portion which, in that type of device, must be made very accurately, and must not give rise to any limitation on the free flow of the fluid; since the closure member is an integral part of said portion, it constitutes such a limitation;
- the closure member requires a certain amount of pressure in order to open, but before the device is used for the first time, most spray pumps are not capable of generating the required pressure; each pump is provided with a metering chamber which is also the pump chamber, and said chamber is empty when the device has not yet been used, i.e. it contains only air or an inert gas; as a result, each spray device using such a pump needs to be primed, which constitutes in actuating the device one or more times to expel the air from the chamber of the pump and to replace it with the liquid to be dispensed; the problem then encountered is that, when the pump is actuated on a gas, the pressure generated is significantly lower than the pressure obtained by pumping a liquid, so the pressure generated during priming is generally not sufficient to open the closure member; as a result, the air is not expelled and the pump is not primed so that no spray can be dispensed.

Documents EP-0 031 123 and U.S. Pat. No. 3,336,000 disclose closure systems in which the closure member is opened mechanically, independently of the pressure created by the substance. However, those closure members present the same problems concerning spray applications since they form the end of the fluid flow portion and they prevent the fluid from flowing freely.

SUMMARY OF THE INVENTION

An object of the present invention is to provide a closure system for a dispenser device for dispensing a fluid, which system does not suffer from the above-mentioned drawbacks.

An object of the present invention is thus to provide a closure system that enables the dispenser device for dispensing a fluid to be closed accurately, thereby avoiding any contamination and/or drying out of the substance at the dispensing orifice.

Another object of the invention is to provide a closure system that is opened automatically on actuating the dispenser device for dispensing a fluid.

A further object of the invention is to provide such a closure system that is completely separate from that portion of the dispenser member through which the fluid flows, and that therefore does not interfere with the spray generation and/or with the necessary priming of the device.

The present invention thus provides a dispenser device for dispensing a fluid, the dispenser device comprising a dispenser member such as a pump, ejection means such as an ejection nozzle incorporating a dispensing orifice, actuating means such as a pusher, and a closure system comprising a closure element that is resiliently deformable to go between a closed position in which it closes the dispensing orifice hermetically, and an open position in which it opens the dispensing orifice, said dispenser device being characterized in that said pusher can be displaced a little relative to said ejection nozzle, and in that the closure element is disposed between said pusher and said ejection nozzle so that, when the dispensing device is actuated, the closure element is deformed into its open position by said ejection nozzle or by a memer solid with said ejection nozzle, said closure element returning resiliently into its closed position after the dispensing device has been actuated.

Advantageously, the closure element is provided with a deformable closure wall which closes the dispensing orifice, said closure wall being provided with opening means which open when the closure element is in the open position.

Preferably, the opening means include a slit which opens when the dispenser device is actuated.

Preferably, said closure wall is provided with a substantially concave bottom surface which, in the closed position, is in contact with a convex top surface of the member solid with the dispenser device.

Advantageously, said slit is defined by two edges which move apart during opening of the slit in a manner such as to form a truncated cone when the closure element is in the open position, the small-diameter portion of said truncated cone being defined by the bottom ends of said edges, which ends are situated in the vicinity of the dispensing orifice, so that when the slit closes again, the two edges firstly come into mutual contact at said bottom ends, expelling to the outside any substance remaining in the truncated cone after the dispenser device has been actuated.

Advantageously, while the slit is closing again, said bottom ends of the two edges scrape said convex top surface of the member that is solid with the dispenser member, thereby removing any substance remaining in this place after the dispenser device has been actuated.

Advantageously, said closure element comprises a cylindrical sleeve disposed around and/or fixed to said ejection nozzle, and a deformable closure wall forming an end wall of said sleeve, said closure wall being provided with a slit disposed facing the dispensing orifice, which slit opens whenever the device is actuated.

Preferably, when the closure element is in the open position, said sleeve is in a deformed state such that the closure element is urged resiliently into its closure position.

In another embodiment of the invention, the closure element is implemented in the form of a disk provided with a hole which is closed in the closed position, and which opens to pass a member solid with the dispenser device whenever said dispenser device is actuated.

Advantageously, said closure element is made of an elastomer, such as a butyl rubber.

Other characteristics and advantages of the present invention appear from the following detailed description given by way of non-limiting example and with reference to the accompanying drawings.

DESCRIPTION OF PREFERRED EMBODIMENTS

Although the closure system of the present invention is applicable to any type of dispenser device for dispensing a fluid, the present description is given with reference to a spray device including a pump actuated by a pusher.

Figure 1:
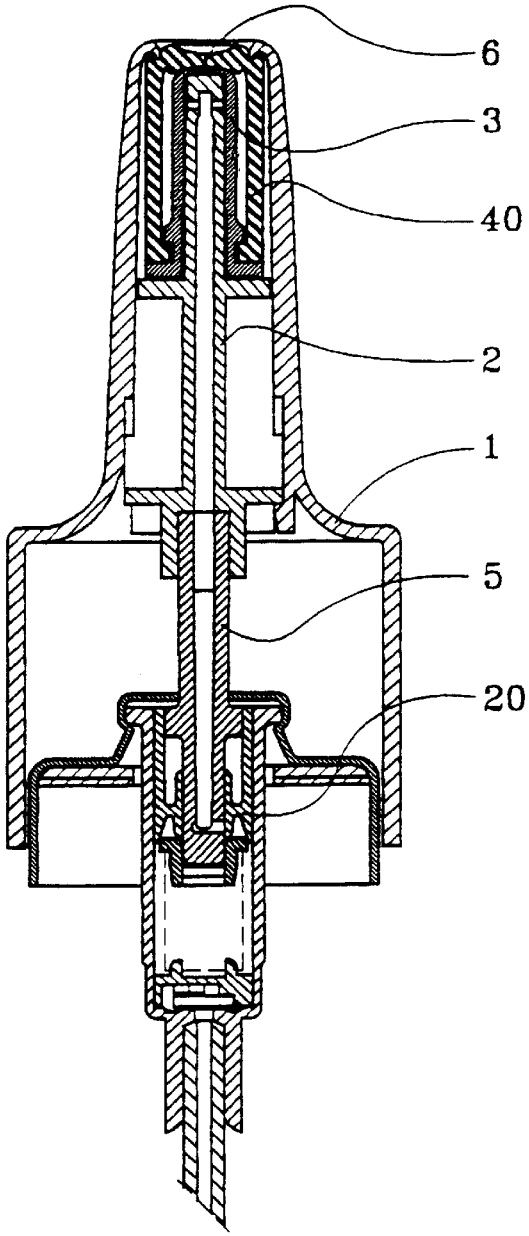
FIG. 1 is a diagrammatic vertical section view of a dispenser device for dispensing a fluid, the device incorporating a closure system of the present invention, shown in its closed position.
Figure 2:
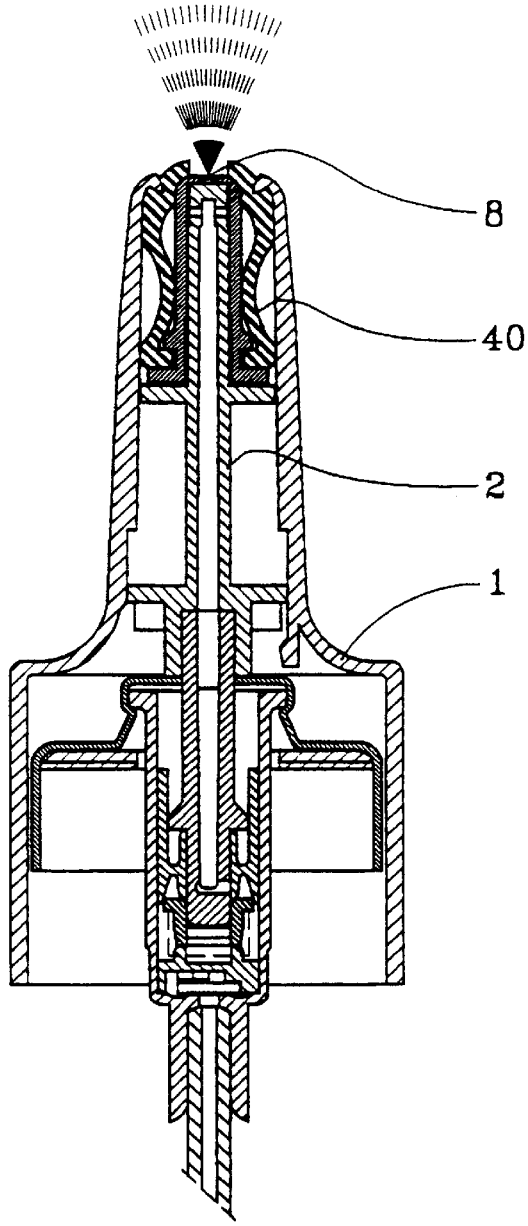
FIG. 2 is a view similar to the FIG. 1 view, showing the closure system in its open position.

As shown in FIGS. 1 and 2, the dispenser device for dispensing a fluid includes a pump 20 which may be any standard pump and which is therefore not described in greater detail below, said pump being connected firstly to a fluid tank (not shown) and secondly to a dispensing orifice 8 via an expulsion channel 2 and 5. The pump is actuated by actuating means such as a pusher 1 which, together with the outlet portion of the expulsion channel 2, define a dispensing head. As shown in particular in FIGS. 1, 2, and 3, the head of the spray dispenser device is subdivided into two main components, namely a body 1 solid with the pusher, and an ejection nozzle 3. In a standard spray dispenser device, the nozzle is usually made integrally with said body. These two components are separated to enable a closure element 4 to be interposed between them, i.e. between the body 1 of the dispensing head and the ejection nozzle 3. As is common, a spray jet-forming insert 2 whose function is to reduce dead volume and to create the channel shape suitable for obtaining good spraying, is inserted by being pushed into the ejection nozzle element 3, and thus forms the end of the expulsion channel, the other end of the insert being disposed on the outlet tube 5 of the pump 20. Naturally, the closure system of the present invention also operates with a dispensing head that is not provided with an ejection nozzle incorporating a spray jet. It is necessary merely to be possible for the closure element 4 to be disposed between the body 1 and a member solid with the pump, provided that said member can move relative to said body 1, as described below.

The unit comprising the ejection nozzle 3 and the insert 2 is mounted in the body 1 so that it can slide in said body 1 over a limited stroke, and the unit is prevented from being accidently separated from said body 1 in any suitable manner, in particular by snap-fastening means.

Figure 3:
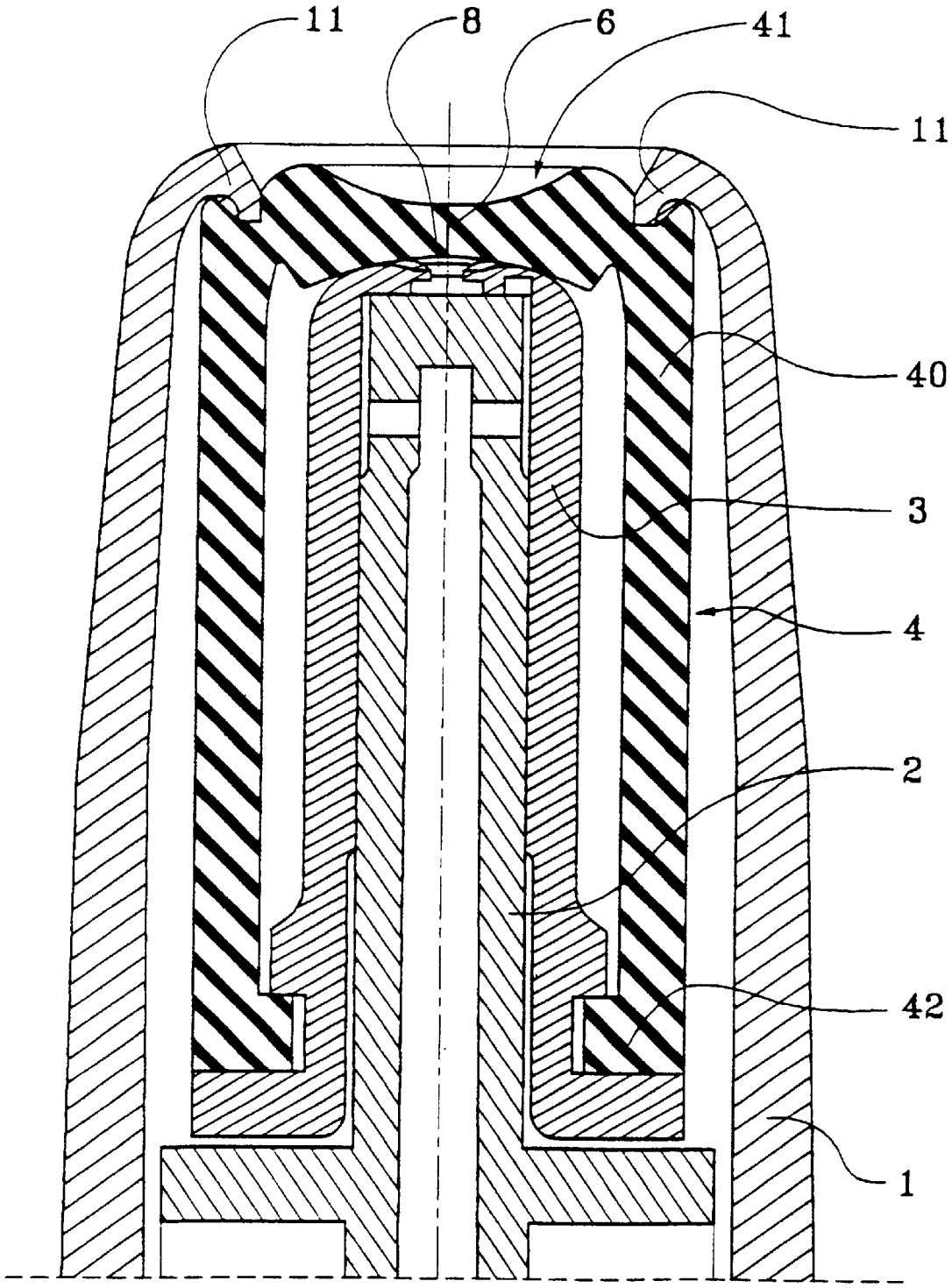
FIG. 3 is an enlarged diagrammatic vertical section view of the closure system of the present invention, shown in the closed position.
Figure 4:
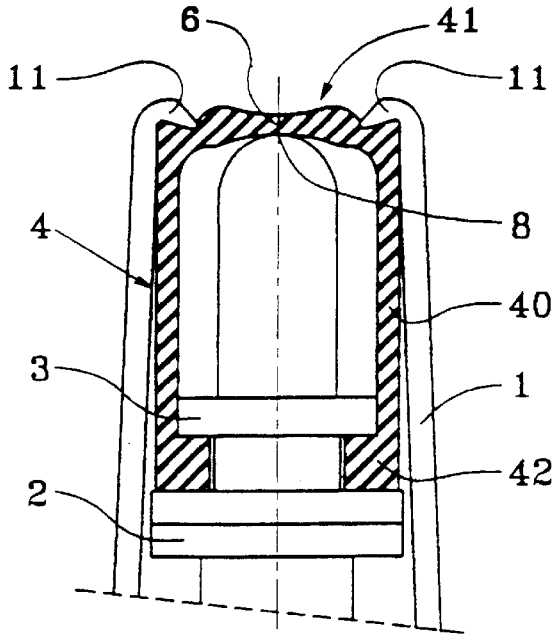
FIGS. 4 and 5 are diagrammatic vertical section views of the closure system of the invention, respectively in the closed position and in the open position.

The closure element 4 is preferably made of a suitable elastomer, such as a butyl rubber which is mounted in airtight manner on the ejection nozzle 3. The closure element 4 preferably comprises a tubular sleeve portion 40 which is terminated at one end by a closure wall 41 forming an end wall for said sleeve 40. Advantageously, said sleeve portion 40 is mounted and/or fixed around said ejection nozzle 3, advantageously by snap-fastening type means 42, and said closure wall 41 covers the dispensing orifice 8 of the device and closes it in airtight manner. The closure wall 41 of said closure element 4 is provided with opening means 6, advantageously implemented in the form of a slit which is disposed facing said dispensing orifice 8. When the closure element 4 is in the closed position, the slit is held closed in airtight manner so as to prevent any substance remaining in or in the vicinity of the dispensing orifice 8 after the dispenser device has been actuated from being contaminated and/or from drying out. As shown in FIGS. 3 and 4, the closure element 4 is held at the periphery of its closure wall 41 by a rib 11 in the body 1, which rib co-operates with a corresponding groove provided in said closure wall 41. When the closure element is in the closed position, this advantageous characteristic makes it possible for a radial force to be exerted on said closure wall 41, so that the slit 6 is held closed in airtight manner in said closure position.

Advantageously said slit 6 is defined in the closure wall 41 by two edges 61, 62 (shown in FIGS. 5 and 7) which come into airtight contact with each other when the closure element 4 is in the closed position. In addition, in a preferred embodiment of the invention, the sleeve 40 of the closure element 4 may be implemented in a manner such that it is deformable. Thus, when the closure element 4 is in its open position, by deforming, the sleeve 40 urges the closure element towards its closure position, thereby returning the closure-element to its closed position after the device has been actuated.

The closure system of the present invention operates as follows.

Figure 5:
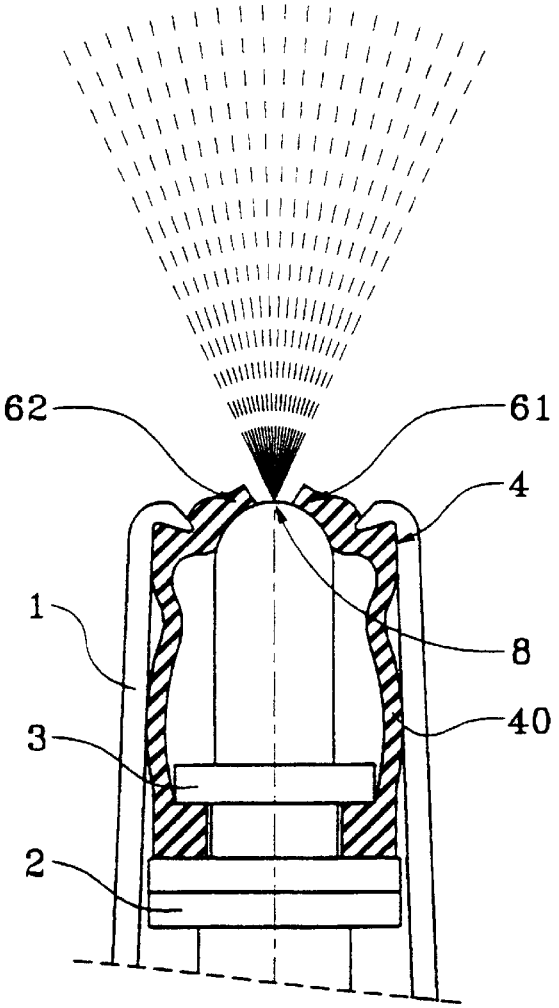
Figure 6:
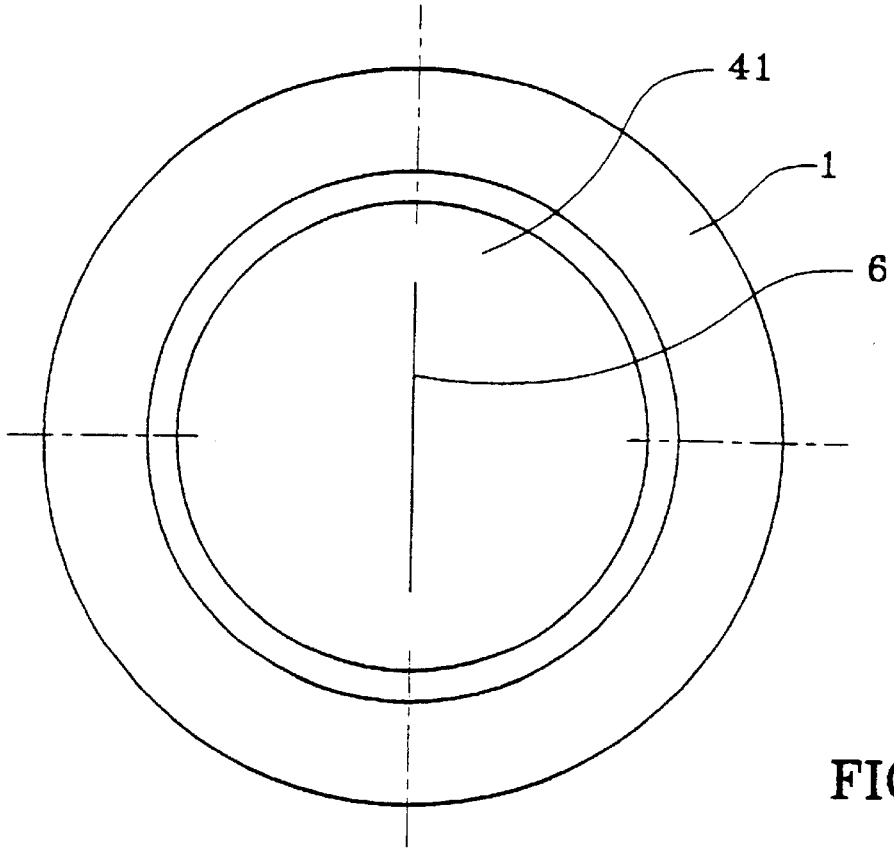
FIGS. 6 and 7 are diagrammatic plan views of the closure element of the closure system of the present invention, respectively in the closed position and in the open position.
Figure 7:
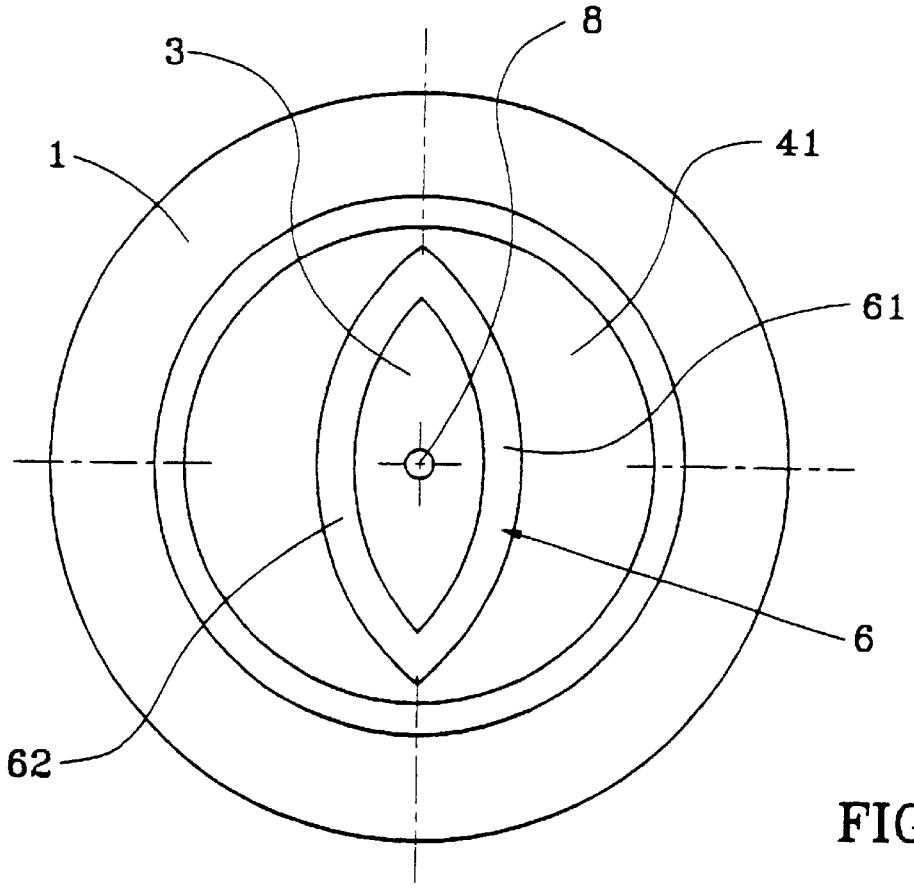

As described above, when the dispenser device for dispensing a fluid is not actuated, the closure element closes the dispensing orifice 8 of the pump in airtight manner, so as to prevent any contamination and/or drying out of the substance remaining in the pump. On actuating the device, i.e. when a pressure is exerted by the user on the pusher 1, said pressure, which is exerted downwards as shown in the figures, causes the body and the unit comprising the ejection nozzle 3 and the insert 2 to move relative to each other. For this purpose, the sleeve 40 of the closure element 4 is resiliently deformed and the ejection nozzle simultaneously deforms the closure wall 41 by opening the slit 6 upwards, as shown in FIGS. 2, 5, and 7. This is achieved by means of the resistance of the pump device 20 to deformation being greater than the resistance to deformation of the sleeve 40 of the closure element 4. Thus, on actuating the spray dispenser device, firstly the unit comprising the ejection nozzle 3 and the insert 2 is displaced relative to the body 1, and therefore the sleeve 40 of the closure element is deformed. As a result, the slit 6 is opened by said ejection nozzle 3 which deforms the closure wall 41 at the slit 6, while the peripheral edge of said closure wall is advantageously held by the rib 11 in the body 1. Advantageously, the body 1 and the unit comprising the nozzle 3 and the insert 2 continue to move relative to each other until abutment means, such as a shoulder, prevent any further relative movement. It is only then that the force exerted by the user on the pusher 1 is transmitted to the pump device in order to actuate it. Thus, the substance contained in the tank is ejected by the pump only after the closure element 4 has been fully opened, the opening being achieved mechanically by means of the ejection nozzle 3 in the example shown in the figures. Naturally, such mechanical opening may also be achieved by a one-piece portion forming the ejection channel of the pump if the device is not provided with an ejection nozzle.

At the end of device actuation, when the pusher 1 is released by the user, the assembly formed by the pusher 1 and by the unit comprising the ejection nozzle 3 and the insert 2 is returned to its initial position by the return spring of the pump, and because of the spring action exerted by the sleeve 40 of the deformed closure element. As a result, the closure element 4 returns to its closed position in which the sleeve 40 is exactly cylindrical and the slit 6 is closed hermetically.

An advantageous characteristic of the invention is obtained by the fact that the opening means are implemented in the form of a slit in the closure wall 41 of the closure element 4. Thus, this slit is defined, as described above, by two edges 61 and 62 which are in airtight contact with each other when the closure element 4 is in the closed position, and which open under the effect of the body 1 and the unit comprising the ejection nozzle 3 and the insert 2 moving relative to each other, during actuation. As shown in FIGS. 2 and 5, when the closure element 4 is in the open position, the slit 6 opens such that the edges 61 and 62 define a truncated cone with the small-diameter portion of said truncated cone being situated at the bottom ends (as shown in the figures) of said edges 61, 62, which ends are situated in the vicinity of the dispensing orifice 8 of the device. Therefore, when the closure element 4 returns from its open position to its closed position, after the device has been actuated, the edges 61, 62 come into contact with each other firstly at their bottom ends, and then the slit 6 closes progressively over the entire height of said edges, i.e. over the thickness of the closure wall 41. Thus, any substance remaining inside said truncated cone after the device has been actuated is driven out of the device, thereby further limiting the risks of contamination and/or of drying out at this level. In order to guarantee maximum effectiveness for these characteristics, it is advantageous for provision to be made for the closure wall 41 to be arcuate. Thus, when the closure element is in the closed position, a compression force is established that acts to close the dispensing orifice 8 in airtight manner. A particularly advantageous arcuate shape is shown in FIG. 3. In this embodiment, the inside surface of the closure wall 41 is concave and, in the closed position, it is in intimate contact with the top surface of the nozzle 3, which is convex. Similarly, the outside surface (i.e. the top surface as shown in FIG. 3) of the closure wall 41 is also concave. This particular dual concave shape of the closure wall 41, together with the rib 11 in the body 1, which rib bears against a corresponding groove provided in the periphery of said wall 41, offers the following advantages:

- in the closed position, the closure wall 41 abuts firstly against the convex surface of the nozzle 3, and secondly against the peripheral rib 11 in the body 1; therefore a substantially radial force is created that urges the two edges 61, 62 of the slit 6 into contact with each other; similarly, any slight accidental stress on the pusher 1, e.g. during transport, increases this compression force and thus prevents the slit 6 from opening accidentally; naturally, this applies only if the stress on the pusher 1 is lower than the resistance to deformation of the sleeve 40 of the closure element 4; and
- when the slit 6 closes again after the pump has been actuated, the two bottom ends of the edges 61, 62 scrape over the convex surface of the nozzle 3, thereby cleaning said nozzle 3; this guarantees maximum expulsion of any substance remaining in this place after each actuation.

Advantageously, it is possible to provide a bacteriostat between the closure element 4 and the ejection nozzle element 3. In this way, maximum protection is obtained for the substance. By combining such a bacteriostat with the above-described arcuate shape, it is possible to obtain the advantage that the bacteriostat is not delivered to the user on actuating the pump, because almost all of the substance remaining in this place is removed during the preceding closure of the closure element.

The above description is given with reference to a particular application of the invention concerning a spray dispenser device including a pump. Naturally, with the necessary modifications obvious to the person skilled in the art, the closure device of the invention may also be implemented with different types of pump or with different types of dispenser, such as, for example, dispensers for dispensing drops (in particular medicated eye drops), pharmaceutical or cosmetic creams, and more generally any other type of fluid. A preferred characteristic is that all of such devices include suction systems preventing outside air from entering or returning into the fluid tank.

The closure element itself may also be modified without going beyond the ambit of the invention. In particular, its slit-shaped opening may be replaced with a very small hole capable of being enlarged sufficiently to enable a fine tube to pass through it, in particular for dispensing droplets. In which case, unlike the spray examples, an ejection nozzle including a swirl chamber for creating the spray is not necessary. Similarly, the deformable hollow cylindrical sleeve of the closure element may be replaced by a mere disk made of an elastomer material for less constraining applications. Thus, for example, in an ophthalmological application, the closure element may be implemented in the form of such a disk provided with a hole. In the closed position, the hole is closed and closes the dispensing orifice of a dispensing tube in airtight manner. When the device is actuated, said dispensing tube deforms said disk so as to open said hole, thereby enabling said tube to pass through said hole so as to deliver a drop of substance. After actuation, the tube is returned to its initial position, and the hole in the disk closes again automatically.

What is claimed is:

1. A dispenser device comprising:

a pump;

an ejection nozzle;

a dispensing orifice incorporated into said ejection nozzle;

an actuator, said actuator displaced relative to the ejection nozzle during dispensing; and a closure system disposed between said actuator and said ejection nozzle, said closure system comprising a closure element, said closure element resiliently deformable to go between a closed position in which said closure element hermetically closes the dispensing orifice, and an open position in which said closure element opens the dispensing orifice wherein, when the dispensing device is actuated, said closure element is deformed into said open position by said ejection nozzle or a member solid with said ejection nozzle, said closure element returning resiliently to said closed position after the dispensing device has been actuated.

2. A device according to claim 1, in which the closure element comprises a deformable closure wall which closes the dispensing orifice, said closure wall containing opening means for allowing a dispensing medium to expel outside the dispensing device when said closure element is in the open position.

3. A device according to claim 2, wherein said opening means comprises a slit facing said dispensing orifice.

4. A device according to claim 3, wherein said closure wall is provided with a substantially concave bottom surface which, when said closure element is in the closed position, said closure wall is in contact with a convex top surface of the member solid with said ejection nozzle.

5. A device according to claim 2, wherein said slit comprises two edges which move apart during opening of the slit in a manner such as to form a truncated cone when the closure element is in the open position, a small-diameter portion of said truncated cone being defined by respective bottom ends of said two edges, said bottom ends positioned with the dispensing orifice, so that when the slit closes, the two edges firstly come into mutual contact at said bottom ends, expelling outside any of said dispensing medium remaining in the truncated cone after the dispenser device has been actuated.

6. A device according to claim 5, wherein, while the slit is closing, said bottom ends of the two edges scrape said convex top surface of the member solid with said ejection nozzle, thereby removing said dispensing medium remaining after the dispenser device has been actuated.

7. A device according to claim 1, wherein said closure element comprises a cylindrical sleeve disposed around and/or fixed to said ejection nozzle, and a deformable closure wall forming an end wall of said cylindrical sleeve, said closure wall being provided with a slit facing the dispensing orifice, said slit opening when the device is actuated.

8. A device according to claim 7, wherein, when the closure element is in the open position, said sleeve is in a deformed state so that the closure element is urged resiliently into the closed position.

9. A device according to claim 1, wherein said closure element comprises a disk provided with a hole.

10. A device according to claim 1, wherein said closure element is made of an elastomer.

11. A device according to claim 10, wherein said elastomer is a butyl rubber.

12. A device according to claim 3, wherein said closure wall is provided with a substantially concave bottom surface which, when said closure element is in the closed position, said closure wall is in contact with a convex top surface of the ejection nozzle.

13. A device according to claim 6, wherein a bacteriostat is disposed between said closure element and said ejection nozzle.

* * * * *